United States Patent [19]

Surletta et al.

[11] Patent Number: 4,776,572

[45] Date of Patent: Oct. 11, 1988

[54] BOX SPRING ASSEMBLY

[76] Inventors: Zygmunt M. Surletta, 18360 Mott St., East Detroit, Mich. 48021; David R. Bombard, 28727 Brentwood, Southfield, Mich. 48076

[21] Appl. No.: 113,227

[22] Filed: Oct. 23, 1987

[51] Int. Cl.[4] ..... A47C 23/04

[52] U.S. Cl. ..... 267/107; 5/247

[58] Field of Search ..... 5/247, 255; 267/85, 267/86, 103, 106, 107, 110

[56] References Cited

U.S. PATENT DOCUMENTS

| | | | |
|---|---|---|---|
| 3,722,013 | 3/1973 | Surletta | 5/247 |
| 3,825,960 | 7/1974 | Inman et al. | 5/247 |
| 3,833,948 | 9/1974 | Surletta et al. | 5/247 |
| 3,835,485 | 9/1974 | Klicki | 5/247 |
| 4,000,531 | 1/1977 | Inman | 5/247 |
| 4,068,329 | 1/1978 | Gross et al. | 5/255 |
| 4,195,376 | 4/1980 | Kitchen | 5/255 |
| 4,207,634 | 6/1980 | Kitchen et al. | 5/255 |
| 4,339,834 | 7/1982 | Mizelle | 267/107 X |
| 4,452,438 | 6/1984 | Hancock et al. | 267/103 |
| 4,470,584 | 9/1984 | Mizelle | 9/198 |

*Primary Examiner*—Duane A. Reger

[57] ABSTRACT

A box spring 10 for supporting a load includes a horizontally extending frame 12 which defines a load supporting area, a plurality of formed wire springs 14 mounted on the frame 12 for providing symmetrical resilient support under the load, and a grid 16 spaced above and in parallel relationship with the frame 12. Each spring 14 is defined by an integral wire having a horizontally extending section 32 with first and second ends 34, 36 and a fishmouth section 54, 56 associated with each end. Each fishmouth section 54, 56 includes a V-shaped portion with a torsion bar 58, 68. The V-shaped portion of the fishmouth section 54 adjacent the first end 34 of the horizontally extending section 32 faces oppositely from the V-shaped portion of the fishmouth section 56 adjacent the second end 36. Spacer segments 41, 47 are located on opposing sides of the horizontal section 32 to provide stability to the spring 14 under load.

15 Claims, 3 Drawing Sheets

BOX SPRING ASSEMBLY

TECHNICAL FIELD

This invention relates to a box spring assembly for bedding usage and to an improved corner construction of the assembly.

BACKGROUND ART

Conventional box spring assemblies typically include springs which tend to lean in one direction or another away from a vertical plane in reaction to the application of a vertically applied load. See, for example, U.S. Pat. Nos. 3,722,013, 3,825,960; 3,833,948; 3,835,485; 4,000,531; 4,068,329; 4,195,376; 4,207,634; 4,452,438; and 4,470,584.

Partial solutions to this problem have called for the use of large springs, which provides a broad platform to shoulder the load. One problem with such approaches, however, lies in the need to provide firmer resistance in selected locations of the box spring assembly than in other locations. Frequently this problem is left unsolved by the difficulty of locating bulky springs within the spacial constraints imposed by the assembly. Thus, the bulk of conventional springs imposes restraints on the number and location of sites within the assembly at which the springs can be located. Diminutive springs, however, tend to rock or lean away from a vertical position when the load is applied.

DISCLOSURE OF INVENTION

An object of the present invention is to provide an improved box spring assembly that has particular utility in the bedding industry. More specifically, it is an object of the present invention to provide a unique spring configuration which will distribute an applied load equally across its length such that there will be no resultant turning effect, or leaning of the spring when a load is applied.

In carrying out the above object, the invention is characterized by a plurality of springs for providing symmetrical resilient support under the load. Each spring is defined by an integral formed wire having a horizontally extending section and an upper portion extending from each end in opposing directions from each other and in a horizontal plane with the horizontally extending section. A spacer segment depends downwardly from each upper portion, so that the spacer segments are located on opposite sides of the horizontally extending section to provide stability to the spring under load. A fishmouth section is connected to each spacer segment, with the fishmouth sections associated with a given spring facing oppositely from each other. The fishmouth sections each include a torsion bar which is located generally below the central segment of each spring. This structural configuration provides a compact spring which offers a wide range of positional choices for each spring within the assembly, together with the concomitant advantage of ease of construction.

The objects, features and advantages of the present invention and are readily apparent from the following detailed description of the best modes for carrying out the invention, when taken in connection with the accompanying drawings.

BEST MODES FOR CARRYING OUT THE INVENTION

Figure 1:
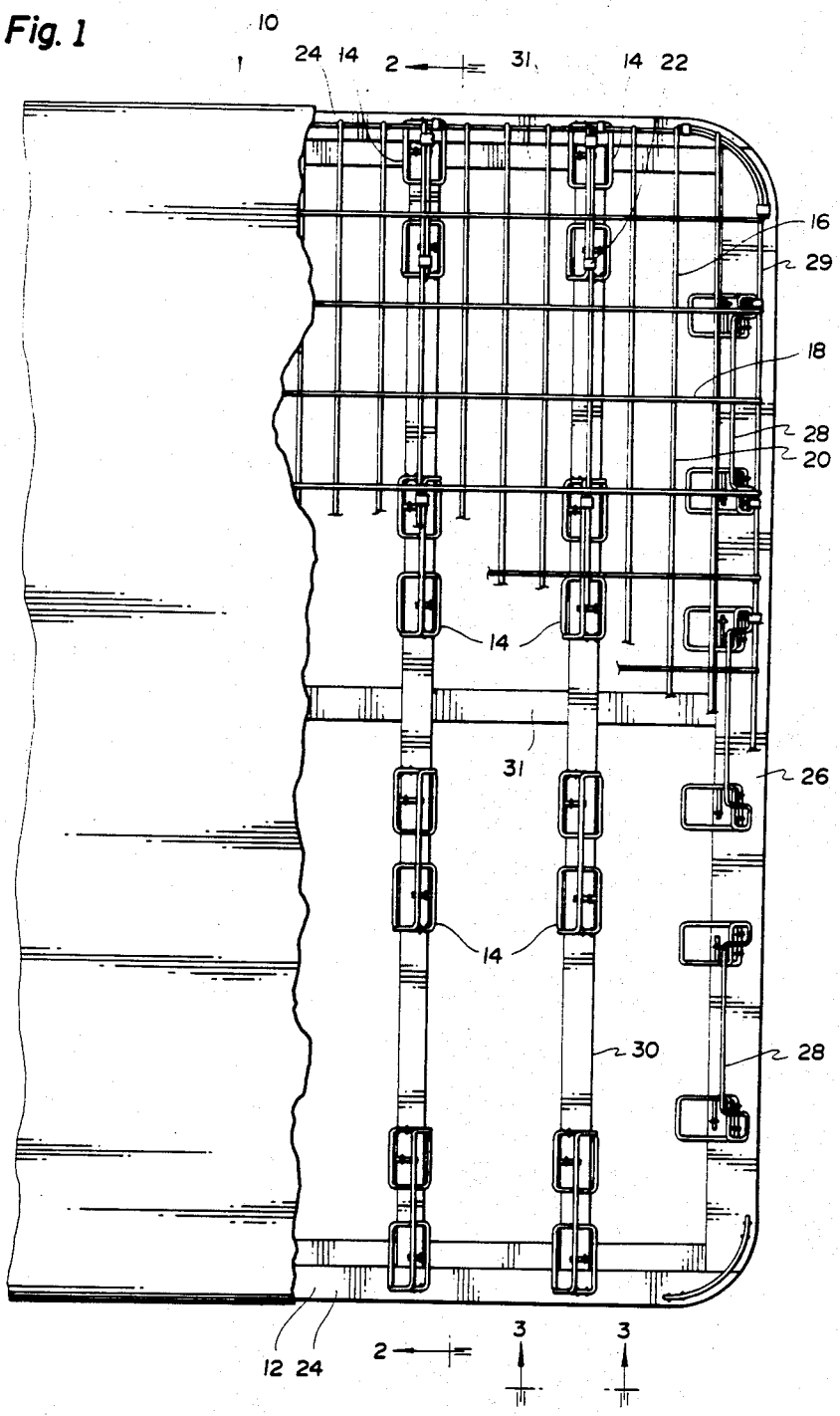
FIG. 1 is a plan view of box spring assembly constructed in accordance with the present invention, with part of an overlying grid cut away for ease of illustration.

Referring to FIG. 1 of the drawings, a box spring assembly that embodies the present invention is generally indicated by reference numeral 10 and includes a horizontally extending frame 12 which defines a load supporting area. Mounted on the frame 12 is a plurality of formed wire springs 14 for providing resilient support under a vertically applied load. A grid 16 is spaced above, and is in parallel relationship with the frame 12. Defining the grid 16 is a first set of spaced parallel wires 18 and a second set of spaced parallel wires 20 which extend orthogonally with respect to the first set of wires 18. The grid 16 is secured by connections 22 to the springs 14 to provide resilient support for the grid 16. As best illustrated in FIG. 2, the grid 16 is spaced above and lies in parallel relationship with the frame 12.

Continuing with reference to FIG. 1, the frame 12 is defined by a pair of lateral side edges 24 and by a pair of end members 26 which are located at the opposite longitudinal ends of the assembly 10. The end members 26 cooperate with the side members 24 to form a rectangular configuration and also support marginal springs 28 which are associated with the end members of the assembly. Slats 30 extend laterally between the side edges 24 and support the springs 14 which are associated with each area of the assembly other than the end members 26, where the marginal springs 28 are attached. The first set 18 of spaced parallel wires which are included in the grid 16 extend longitudinally along the length of the frame 12. Extending transversely across the first set of wires, the second set of wires 20 extend laterally across the frame 12 between its side edges 24. The wires which comprise the first and second sets 18, 20 are welded to each other at their crossing junctures. Each border of the grid 16 includes wires which are preferably made from heavier, 3 to 9 gauge wire. The wires 18 and 20 of the grid 16 are of lighter gauge, and are preferably made from 12 to 14 gauge wire stock.

Figure 2:
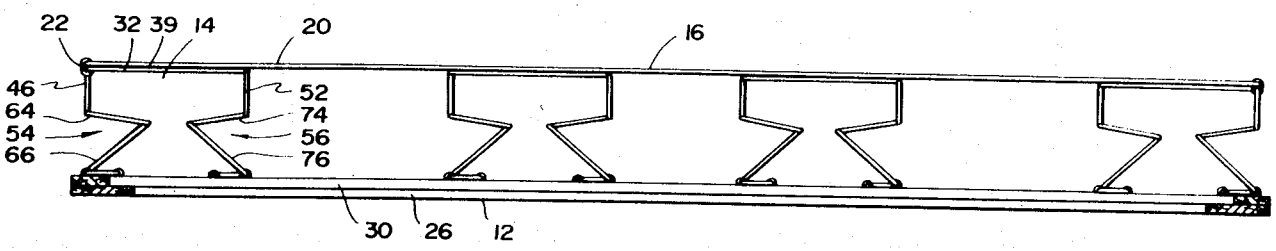
FIG. 2 is a sectional view of a portion of the box spring assembly as viewed from the line 2—2 in FIG. 1.
Figure 4:
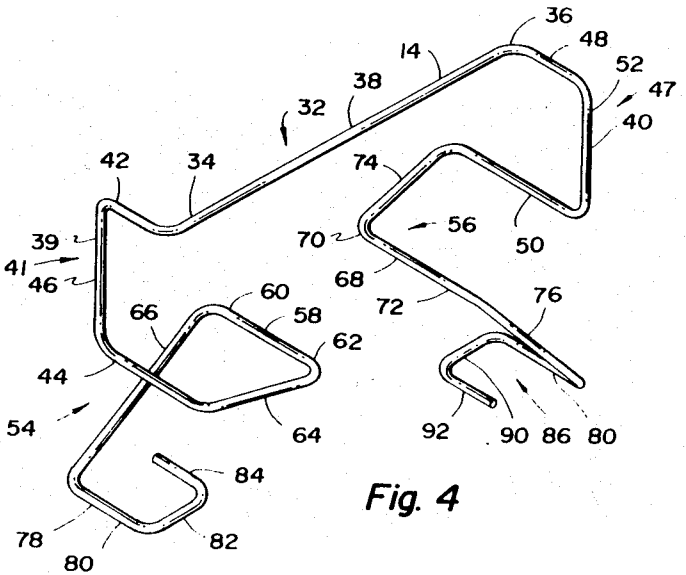
FIG. 4 is a perspective view of a first embodiment of one of the springs in the box spring assembly.
Figure 3:
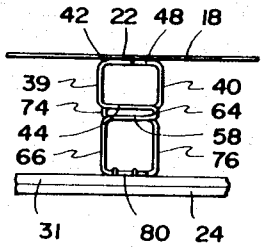
FIG. 3 is a partial side elevational view of the box spring assembly as viewed from the line 3—3 in FIG. 1.

As best shown in FIGS. 2–4, each spring 14 in the preferred embodiment is defined by an integral wire having a horizontally extending section 32 including first and second ends 34, 36 and a central segment 38 which connects the ends. Lying below the first and second ends 34, 36 are associated spacer segments 41, 47. In the preferred embodiment of spring 14, as best illustrated in FIG. 4, each spacer segment 41, 47 comprises a U-shaped vertical section 39, 40. The U-shaped vertical section 39 which is associated with the first end 34 has upper 42 and lower 44 portions and a member 46, which connects the portions 42, 44 at one end thereof. Likewise, the U-shaped section 40 which is associated with the second end 36 has upper 48 and lower 50 portions and a member 52, which connects the portions 48, 50 at one end thereof.

Each upper portion 42, 48 extends from and lies in a horizontal plane with the horizontally extending section 32. The member 46 of the U-shaped section 39 depends downwardly from the upper portion 42 which is associated with the first end 34. Similarly, the member 52 of the U-shaped section 40 depends downwardly from the upper portion 48 which is associated with the second end 36, so that the members 46, 52 of the U-shaped sections 39, 40 are located on opposing sides of the horizontally extending section 32 to provide stability to each spring 14 under load.

Figure 5:
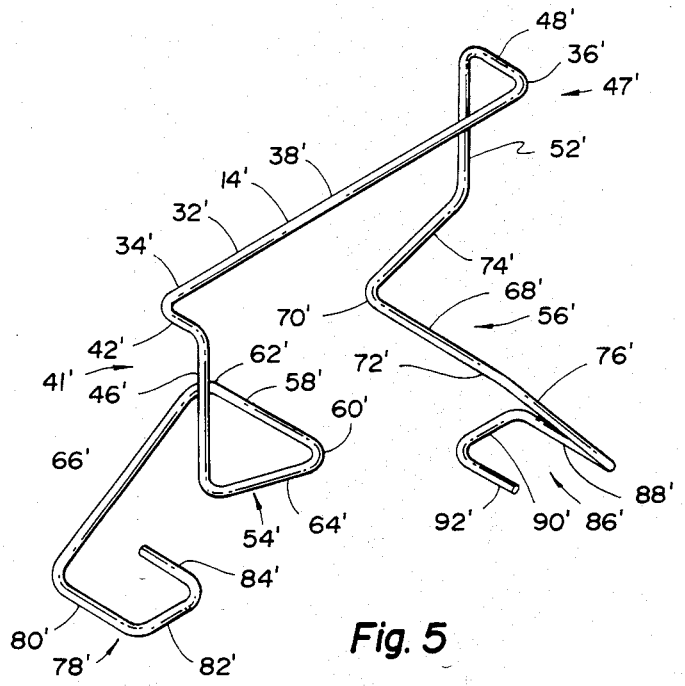
FIG. 5 is a perspective view of a second embodiment of one of the springs in the box spring assembly.

Turning now to FIG. 5, an alternate embodiment of formed wire spring 14' is depicted. This embodiment of the invention includes many of the structural and functional features of the preferred embodiment illustrated in FIG. 4. For ease of reference, and to facilitate understanding, where possible, like reference numerals are used in FIG. 5. In this embodiment, each spacer segment 41', 47' comprises a member 46', 52'. As in the preferred embodiment, in the alternate embodiment, each upper portion 42', 48' extends from and lies in the horiztonal plane with the horizontally extending section 32'. In the alternate embodiment, the member 46' of the spacer segment 41' depends downwardly from the upper portion 42' which is associated with the first end 34'. Similarly, the member 52' of the spacer segment 47' depends downwardly from the upper portion 48' which is associated wtih the second end 36'. Thus, the members 46', 52' of the spacer segments 41', 47' are located on opposing sides of the horizontally extending section 32' to provide balanced and symmetrical stability to each spring 14' under load.

Continuing with primary reference to the preferred embodiment of spring 14 as best illustrated in FIGS. 2–4, spring 14 has a pair of fish-mouth sections 54, 56 which are connected respectively to the lower portions 44, 50 of each U-shaped section 39, 40. As best shown in FIG. 2, each fishmouth section 54, 56 associated with a given spring 14 includes a V-shaped portion which provides resilient support to the load. Proximate the first end 34 of each spring, the associated fishmouth section 54 includes a torsion bar 58 having opposite ends 60, 62. Upper and lower spacer bars 64, 66 extend from the opposite ends 60, 62 of the torsion bar 58 in a spaced relationship to each other. The upper spacer bar 64 is integrally connected to the lower portion 44 of the U-shaped section 39. At the distal end of the spring 14, associated with its second end 36, the fishmouth section 56 includes a torsion bar 68 which has opposing ends 70, 72.

Extending from the opposite ends 70, 72 in a spaced relationship to each other are upper and lower spacer bars 74, 76. The upper spacer bar 74 is integrally connected to the lower portion 50 of the U-shaped section 40 proximate the second end 36 of each spring 14. The V-shaped portion of the fishmouth section 54 adjacent the first end 34 of the horizontally extending section 32 faces oppositely from the V-shaped portion of the fishmouth section 56 adjacent to the second end 36.

While specific embodiments of the fishmouth section 54, 56 are shown, it should be understood that each fishmouth section generally includes a configuration of formed wire at an end 34, 36 of one of the springs 14, each fishmouth section 54, 56 having at least one torsion bar 58 and two spacer bars 64, 66 extending from opposite ends 60, 62 of the torsion bar 58 which creates a V in side elevation. At least one of the bars 64, 66 extending from the opposite ends 60, 62 of the torsion bar 58 provides elevation to the spring 14.

In operation, upon application of a load downwardly upon the spring 14, the V-shaped portions associated with each spring 14 move toward each other without protruding beyond the dimensions of the horizontally extending section 32. Thus, each spring 14 remains in isolated, non-contacting relationship with neighboring springs 14.

As best shown in FIG. 2, the length of the horizontally extending section 32 of each spring 14 is between two and three times the length of each upper spacer bar 64, 74 to facilitate placement of the springs and to provide added support to the load at selected locations within the box spring assembly 10. Thus, in practicing the invention, the relative compactness of each spring allows, in the assembly operation, the placement of a higher number of springs 14 per unit area for example, in the central portions of the assembly 10 than in the perimetral areas.

Turning now to FIGS. 2 and 4, it can be seen that the torsion bars 58, 68 of each spring 14 are located generally adjacent each other below the central segment 38 of the horizontally extending section 32. Each torsion bar 58, 68 is inclined and located within a vertical plane which extends laterally between the side edges 24 of the frame 12, the vertical planes being in a generally parallel relation to each other. Thus, in operation, there is little tendency for the straight horizontally extending section 32 of each spring 14 to sag under an applied load, since each spring 14 is supported vertically below its central segment 38 by the torsion bars 58, 68 of the associated fishmouth sections 54, 56.

In one embodiment of the invention, the upper portions 42, 48 at each end 34, 36 of the horizontally extending section 32 of each spring 14 extend orthogonally from the horizontally extending section 32. In this embodiment, the horizontally extending section 32 of each spring is in parallel relationship with one of the sets 18, 20 of the spaced parallel wires, while the upper portions 42, 48 at each end of the horizontally extending section 32 are in parallel relationship with the other one of the sets 18, 20 of spaced parallel wires.

As best shown in FIG. 1, the horizontally extending section 32 of each spring 14 is in parallel abutting relationship with one of the wires of the first set 18 of spaced parallel wires. As also illustrated in FIGS. 1 and 3, the upper portion 42 extending from the first end 34 of the horizontally extending section 32 of each spring 14 is in parallel abutting relationship with one of the wires of the first set 18 of spaced parallel wires.

In the alternate embodiment, the formed wire springs 14' are each defined by an integral wire having a horizontally extending section 32' including first and second ends 34', 36' and a central segment 38' which connects the ends. Extending from each end of the horizontally extending section is an upper portion 42', 48', each of which lies in a plane which is parallel to the horizontally extending frame 12. Spacer members 46', 52' depend downwardly from each upper portion 42', 48'. A pair of fishmouth sections 54', 56' are connected respectively to each spacer member 46', 52'. As in the preferred embodiment, each fishmouth section 54', 56' includes a V-shaped portion which provides resilient support to the load.

With continuing reference to FIG. 5, it can be seen that the spacer members 46', 52' lie on alternate sides of the horizontally extending section 32' of each spring 14'. In practice, under application of the load, the downwardly applied force is borne equally by the vertical spacer members 46', 52' with there being no resultant turning effect about the horizontally extending section 32' of each spring 14'. Thus, upon application of the load, each spring 14' tends not to rock or lean away from a vertical plane which passes through the horizontally extending section 32'.

Turning back to FIG. 4, additional features of the spring 14 in each embodiment are shown. The fishmouth section 54 which is associated with the first end 34 further includes a foot 78 with a first foot bar 80 which is integrally connected to the lower spacer bar 66 of the V-shaped portion of the fishmouth section 54. The first foot bar 80 extends orthogonally therefrom. A second foot bar 82 extends horizontally from the first foot bar 80, and a terminal member 84 is connected to the second foot bar 82. Each foot 78 is rigidly attached to the frame to provide a fixed anchor to the springs.

Depending downwardly from the fishmouth section 56 adjacent the second end 36 is a foot 86. A first foot bar 88 is integrally connected to the lower spacer bar 76 of the V-shaped portion of the fishmouth section 56, the first foot bar 88 extending orthogonally therefrom. A second foot bar 90 extends horizontally from the first foot bar 88, ending in a terminal member 92. As with the other foot 78, foot 76 is also rigidly attached to the frame to provide a fixed anchor to the springs. Together, the two feet 76, 78 provide a stable platform across which a vertically applied load is evenly distributed.

Figure 6:
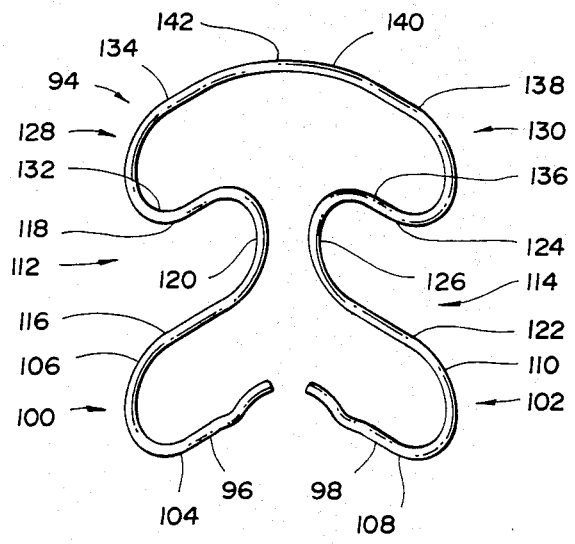
FIG. 6 is a perspective view of a corner spring in the box spring assembly.

The box spring assembly comprising either the preferred embodiment of spring 14 or alternate embodiment 14' also include sinuous, continuous wire corner springs of identical construction, as shown in FIG. 6. Each sinuous, continuous wire corner spring 94 is supported on and projects upwardly from the horizontally extending frame 12, and is defined by a single piece of bent wire. Each corner spring 94 has a pair of spaced supporting pedestals 96, 98 which are attached to the frame 12. A first pair of U-shaped portions 100, 102 each has a first 104, 108 and second 106, 110 section. Each second section 106, 110 is integrally connected to one of the supporting pedestals 96, 98.

A second pair of U-shaped portions 112, 114 each has a first section 116, 122, a second section 118, 124, and a middle section 120, 126 connecting the first and second sections. Each second section 118, 124 thereof is integrally connected to the first section 104, 108 of the associated U-shaped portion 100, 102. A third pair of U-shaped portions 128, 130 each has a first 132 and second 134 section, with each second section 134, 138 being integrally connected to the first section 116, 122 of the associated U-shaped portion 100, 102. Connected to the first section 116, 122 of the associated second U-shaped portion 112, 114, a third pair 128, 130 of U-shaped portions each has a first 132, 136 and second 134, 138 section. An arcuate horizontally extending connecting portion 140, having a center section 142, joins the first section 132, 136 of each third U-shaped portion 128, 130. The arcuate connecting portion 140 is secured to the grid 16. In operation, each sinuous, continuous wire corner spring 94 provides firm support to the grid 16, such that after removal of the load, each sinuous wire corner spring 94 returns to its relaxed dimensions.

In practice, the middle sections 120, 126 of the second pair of U-shaped portions 112, 114 are located generally adjacent each other below the center section 142 of the arcuate connecting portion 140. Thus, in operation, upon application of a load to the corner areas of the box spring assembly 10, the middle sections 120, 126 tend to converge toward each other, yet remain in isolated, non-contacting relationship from each other. Thus, there is no frictional or abutting engagement between each corner spring 94 at any of the adjacent springs 14, 28.

With continuing reference to FIG. 6, another embodiment of the box spring assembly 10 includes sinuous, continuous wire corner springs 94, each having the arcuate connecting portion 140, rather than the supporting pedestals 96, 98 secured to the horizontally extending frame 112. In this embodiment, the supporting pedestals 96, 98 are secured to the grid 16.

While the best modes for carrying out the invention have been described in detail, those familiar with the art to which this invention relates will recognize alternative ways of practicing the invention as defined by the following claims.

What is claimed is:

1. A box spring assembly for supporting a load, comprising:

a horizontally extending frame which defines a load supporting area;

a plurality of springs mounted on the frame for providing symmetrical resilient support under the load, each spring being defined by an integral wire having a horizontally extending section including first and second ends and a central segment connecting the ends, an upper portion extending from each end in opposing directions from each other, and in a horizontal plane with the horizontally extending section, a spacer segment depending downwardly from each upper portion, so that the spacer segments are located on opposite sides of the horizontally extending section to provide stability to the spring under load, each spring also having a fishmouth section connected to each spacer segment, each fishmouth section including a V-shaped portion having a torsion bar including opposite ends and also having upper and lower spacer bars extending from the opposite ends in a spaced relationship to each other, the upper spacer bar being integrally connected to the spacer segment, the V-shaped portion of the fishmouth section adjacent the first end of the horizontally extending section facing oppositely from the V-shaped portion of the fishmouth section adjacent the second end; and a grid spaced above, and in parallel relationship with the frame, the grid being defined by a first set of spaced parallel wires and a second set of spaced parallel wires extending orthogonally with respect to the first set and connections between the wires and the springs that secure the grid to the springs.

2. The box spring assembly of claim 1, wherein each spacer segment comprises a U-shaped section having upper and lower portions and a member, each portion being connected at one end thereof by the member.

3. The box spring assembly of claim 1, wherein each spacer segment comprises a spacer member.

4. The box spring assembly of chain 1, wherein the length of the horizontally extending section of each spring is between 2 and 3 times the length of each upper spacer bar to facilitate placement of the springs and provide added support to the load at selected locations within the box spring assembly.

5. The box spring assembly of claim 1, wherein the torsion bars of the fishmouth sections of each spring are located generally adjacent each other below the central segment of the horizontally extending section, each torsion bar being inclined and located within a vertical plane, the vertical planes being in a generally parallel relationship to each other.

6. The box spring assembly of claim 1, wherein the upper portion at each end of the horizontally extending section of each spring extends orthogonally from the horizontally extending section, so that the horizontally extending section of each spring is in parallel relationship with one set of spaced parallel wires and the upper portion at each end of the horizontally extending section is in parallel relationship with the other set of spaced parallel wires.

7. The box spring assembly of claim 1, wherein each fishmouth section further comprises a foot having a first foot bar integrally connected to the lower spacer bar of the V-shaped portion and extending orthogonally therefrom, a second foot bar extending horizontally from the first foot bar, and a terminal member, connected to the second foot bar, the foot being rigidly attached to the frame to provide a fixed anchor to the springs.

8. The box spring assembly of claim 1, further including sinuous, continuous wire corner springs supported on and projecting upwardly from the frame, each corner spring comprising bent wire having a pair of spaced supporting pedestals attached to the frame, a first pair of U-shaped portions, each having a first and second section, with each second section thereof being integrally connected to one of the pedestals, a second pair of U-shaped portions each having a first section, a second section, and a middle section connecting the first and second sections, with each second section thereof being integrally connected to the first section of the associated U-shaped portion, and a third pair of U-shaped portions each having a first and second section, with each second section thereof being integrally connected to the first section of the associated second U-shaped portion, and an arcuate, horizontally extending connecting portion having a center section which joins the first section of each third U-shaped portion, the arcuate connecting portion being secured to the grid, each sinuous, continuous wire corner spring providing firm support to the grid, such that after removal of the load, each sinuous wire corner spring returns to its relaxed dimensions.

9. The box spring assembly of claim 1, further including sinuous, continuous wire corner springs supported on and projecting upwardly from the frame, each corner spring comprising a piece of bent wire having a pair of spaced supporting pedestals attached to the grid, a first pair of U-shaped portions depending downwardly from the grid, each having a first and second section, with each second section thereof being integrally connected to one of the pedestals, a second pair of U-shaped portions each having a first section, a second section, and a middle section connecting the first and second sections, with each second section thereof being integrally connected to the first section of the associated U-shaped portion, and a third pair of U-shaped portions each having a first and second section, with each second section thereof being integrally connected to the first section of the associated second U-shaped portion, and an arcuate, horizontally extending connecting portion having a center section which joins the first section of each third U-shaped portion, the arcuate connecting portion being secured to the frame, each sinuous, continuous wire corner spring providing firm support to the grid, such that after removal of the load, each sinuous wire corner spring returns to its relaxed dimensions.

10. The box spring assembly of claim 6, wherein the horizontally extending section of each spring is in parallel abutting relationship with one of the wires of said first set of wires.

11. The box spring assembly of claim 6, wherein the horizontally extending section of each spring is in parallel abutting relationship with one of the wires of said second set of wires.

12. The box spring assembly of claim 6, wherein the upper portion extending from an end of the horizontally extending section of each spring is in parallel abutting relationship with one of the wires of said first set of wires.

13. The box spring assembly of claim 6, wherein the upper portion extending from an end of the horizontally extending section of each spring is in parallel abutting relationship with one of the wires of said second set of wires.

14. The box spring assembly of claim 8, wherein the middle sections of the second pair of U-shaped portions are located generally adjacent each other below the center section of the arcuate connecting portion.

15. The box spring assembly of claim 9, wherein the middle sections of the second pair of U-shaped portions are located generally adjacent each other above the center section of the arcuate connecting portion.

* * * * *